US009873553B2

(12) United States Patent
Hardeman et al.

(10) Patent No.: US 9,873,553 B2
(45) Date of Patent: Jan. 23, 2018

(54) BAG

(71) Applicants: MONDI AG, Vienna (AT); N ET B KNAUF & CIE S.C.S., Engis (BE)

(72) Inventors: Peter Hardeman, Heuvelland (BE); Fabio Rencurosi, Bonsin/Somme Leuze (BE)

(73) Assignee: Mondi AG, Vienna (AT)

( * ) Notice: Subject to any disclaimer, the term of this patent is extended or adjusted under 35 U.S.C. 154(b) by 0 days.

(21) Appl. No.: 15/119,916

(22) PCT Filed: Feb. 19, 2015

(86) PCT No.: PCT/IB2015/000419

§ 371 (c)(1),
(2) Date: Aug. 18, 2016

(87) PCT Pub. No.: WO2015/125018

PCT Pub. Date: Aug. 27, 2015

(65) Prior Publication Data

US 2017/0057698 A1 Mar. 2, 2017

(30) Foreign Application Priority Data

Feb. 20, 2014 (DE) ..... 10 2014 002 411

(51) Int. Cl.
*B65D 33/01* (2006.01)
*B65D 30/08* (2006.01)
(Continued)

(52) U.S. Cl.
CPC ..... *B65D 31/04* (2013.01); *B65D 31/10* (2013.01); *B65D 31/14* (2013.01); *B65D 33/01* (2013.01)

(58) Field of Classification Search
CPC ..... B65D 31/04; B65D 31/10; B65D 31/14; B65D 33/01
(Continued)

(56) References Cited

U.S. PATENT DOCUMENTS 3,085,737 A * 4/1963 Horton ..... B65D 33/01 383/101
3,191,850 A * 6/1965 Niemeyer ..... B65D 31/142 383/46
(Continued)

FOREIGN PATENT DOCUMENTS

DE 74 43 280 5/1975
DE 10 2004 013 469 A1 10/2005
(Continued)

*Primary Examiner* — Jes F Pascua
(74) *Attorney, Agent, or Firm* — Whitham, Curtis & Cook, P.C.

(57) ABSTRACT

In a bag with a jacket wall composed of at least two layers closed in each case by means of a longitudinal adhesive seam to form a tube and having two front ends, and with folded bottoms closing the bag at the front ends, and with a filling opening for introducing a filling material, wherein the jacket wall has at least one paper layer and the at least one paper layer at least largely determines the load-bearing capability with filled weight and the mechanical stability of the bag, the usefulness of the bag is improved by the fact that the jacket wall has, on its outside, a layer of a plastic film with a thickness of 60 pm or less, which surrounds the at least one paper layer and protects it from moisture and, in an area of overlapping ends, has adhesion points (K) between which air removal paths (Z) are formed.

12 Claims, 4 Drawing Sheets

(51) Int. Cl.
*B65D 30/24* (2006.01)
*B65D 30/20* (2006.01)

(58) Field of Classification Search
USPC ..... 383/100–103, 44, 45, 53, 111, 125, 126
See application file for complete search history.

(56) References Cited

U.S. PATENT DOCUMENTS 3,309,006 A * 3/1967 Perry ..... B65D 33/01 383/100
4,759,640 A * 7/1988 Groner ..... B65D 31/142 383/44
4,930,904 A * 6/1990 Groner ..... B65D 31/142 383/44
5,493,844 A * 2/1996 Combrink ..... B65B 51/146 53/410
5,967,664 A 10/1999 Giles et al.
6,013,018 A * 1/2000 Bannister ..... B65D 31/142 493/102
6,074,095 A * 6/2000 Bannister ..... B65D 31/142 383/48
6,126,316 A * 10/2000 Bannister ..... B65D 31/142 383/48
6,312,742 B1 * 11/2001 Wood ..... B65B 7/06 383/111
6,986,605 B1 * 1/2006 Allen ..... B65D 33/01 383/101
2007/0047852 A1 * 3/2007 Sharp ..... B65D 33/18 383/106
2007/0181459 A1 8/2007 Lindlbauer
2016/0083144 A1 * 3/2016 Lisek ..... B65D 31/08 383/104
2016/0332781 A1 * 11/2016 Lisek ..... B65D 31/02

FOREIGN PATENT DOCUMENTS

DE 20 2008 014 263 U1 3/2009
DE 20 2011 050 614 U1 12/2011
WO 2010/075146 A2 7/2010
WO 2011/051739 A1 5/2011

* cited by examiner

BAG

BACKGROUND OF THE INVENTION

Field of the Invention

The invention relates to a bag with a jacket wall composed of at least two layers closed in each case by means of a longitudinal adhesive seam to form a tube and having two front ends, and with folded bottoms closing the bag at the front ends, and with a filling opening for introducing a filling material, wherein the jacket wall has at least one paper layer and the at least one paper layer at least largely determines the load-bearing capability with filled weight and the mechanical stability of the bag.

Background Description

The invention thus relates to a paper bag in which the at least one paper layer, which is regularly made of kraft paper, defines the statics of the bag. The jacket wall can in this case consist of a paper layer, but preferably also of two or more paper layers. It is also known to arrange a plastic film layer between the paper layers in order in particular to form a vapor barrier for the filling material. It is in this way possible, for example, to prevent the escape of odors from the bag.

The introduction of filling material into the bag via the filling opening generally also causes air to enter the bag interior too. Various measures have therefore been taken to allow air to be removed from the bag during or after the filling procedure, for example via filling tubes or valve structures that allow air to be carried off even during the filling procedure. While the paper layers permit air removal, albeit slowly, plastic layers are generally airtight. Therefore, for air removal via the jacket wall, perforations or sieve-like inserts have to be provided in the plastic layers, at least in local regions. For paper bags, there is the problem that the paper layers take up moisture or wet from the environment. They may therefore lose stability and, because of the susceptibility of moist paper to soiling, may also become shabby.

Plastic bags are therefore known as an alternative. These consist of at least one plastic layer with a layer thickness sufficient for the desired stability and strength, for example a layer thickness of 100 μm. It is known to provide such a film bag with slits in order to permit the removal of air. In order to prevent loss of filling material in this case, it is known to line the inside of the film bag with a layer of creped filter paper, which keeps the filling material in the bag interior in the area of the slits. A film bag of this kind is difficult to produce and has disadvantages in terms of processing in the manufacture of the bag.

SUMMARY OF THE INVENTION

The object of the present invention is therefore to design a paper bag such that its disadvantages under the effects of moisture are avoided, without for this purpose having to resort to a film bag whose statics are defined by plastic films.

To achieve this object, a bag of the type mentioned at the outset is characterized, according to the invention, in that the jacket wall has, on its outside, a layer of a plastic film with a thickness of 60 μm or less, which surrounds the at least one paper layer and protects it from moisture and, in an area of overlapping ends, has adhesion points between which air removal paths are formed.

The paper bag according to the invention thus has, on its outside, a thin plastic film by which the paper layers determining the statics of the bag are protected from the effects of moisture. The plastic film has an area of overlapping ends, in which area it is affixed to itself via a longitudinal adhesive seam to form a tube. However, the corresponding adhesive points are provided with recesses, such that air removal paths form between them. Although the paper bag is thus protected from the effects of moisture by means of a surrounding plastic film, in particular from the effects of moisture posed by water vapor, it nonetheless permits removal of air, as is provided for by the paper layers.

In a particularly preferred embodiment, the plastic film surrounding the paper bag is designed without perforations, particularly also in the area of the overlapping ends of the plastic films where the adhesive points are located.

The overlapping ends of the plastic film can be affixed to each other by applying a suitable glue, although this can also be done in another way, for example by locally welding the two ends to each other.

The plastic film on the outside of the jacket wall preferably has a thickness of between 10 and 50 μm. Preferably, the plastic film is affixed to the underlying paper layer only at points and is therefore easily removable from the paper layer. This affords the advantage that the plastic film is separable from the paper layers. This is advantageous for the recycling of the bag after its use. However, the easy removability can also be used to remove a plastic film that may have become soiled during transport, so as to be able to present the bag with an outwardly attractive paper layer, for example for sales in a supermarket or the like. In this case, it is expedient if the paper layer located under the plastic film is printed. The plastic film can in this case preferably be transparent, such that the print on the paper layer can be seen through the plastic film. The plastic film can be made of customary film polymers. The use of polyethylene is preferred.

In another embodiment of the invention, the plastic film itself is printed, preferably on the inside of the transparent plastic film facing toward the underlying paper layer. In this way, a clear print is obtained which is easy to read and which can be presented for sales purposes.

In all cases where a transparent plastic film is used, it is expedient at least to configure the underlying paper layer with bleached paper. In this way, it is possible to avoid annoying reflections of the kind that would occur on a dark background arising from unbleached kraft paper.

Moreover, the fact that the plastic film is secured on the underlying paper layer only at points has advantages for the removal of air from the bag, since the flow cross-section for transporting air to the air removal paths between the adhesive points of the plastic film is increased.

To remove the plastic film from the underlying paper layer, the plastic film can be provided with a tear-open aid, which can be formed by a line of weakness, a protruding tab of material or the like.

The invention does not exclude the possibility of the plastic film also being connected across its full surface area to the underlying paper layer.

To ensure the function of the plastic film by which it protects against the effects of moisture, it is expedient if the plastic film is incorporated into the folding of the bottoms.

The paper bag according to the invention is preferably formed with one layer or with two layers of kraft paper, although this does not exclude the possibility that at least one additional paper layer is also used, in particular for considerable mechanical loads. In a structure with several paper layers, the paper layers preferably have a grammage of 70 or 80 g/m$^2$ whereas, when one paper layer is used, a higher grammage may be recommended, for example 120 g/m$^2$. The paper types preferably have a TEA (Tensile Energy Absorption) value as per ISO 1924-3, in the machine direction, of at least 100 J/m$^2$ for normal kraft paper types, at least 180 J/m$^2$ for semi-extensible kraft paper types, and at least 240 for extensible kraft paper types. These kraft paper types are normally used for paper bags in order to determine the statics and strength of the bags. By contrast, the additionally provided plastic film has no function influencing the statics and instead serves mainly to protect the paper layers from the effects of moisture.

The formation of a paper bag according to the invention from a tubular jacket wall with folded bottoms, in particular crossbottoms or square bottoms, is performed in the customary manner and is therefore not described in any more detail here.

The invention affords particular advantages when the bag has two folded bottoms, of which one is provided with a valve opening into which a flat valve is inserted which can be bent open in the shape of a tube to form a filling channel for the filling procedure. The valve forms in this case a first end facing toward the bag interior with respect to the valve opening and a second end facing toward the jacket wall. The protection of the bag from the effects of moisture, by virtue of the plastic film surrounding the paper bag, is effectively supplemented by the fact that the valve has a paper layer which forms the first end and which at the second end is overlapped by a folded film layer having a first film portion and a second film portion connected to the latter via a fold line. In this way, the second end of the paper layer facing toward the outside of the bag is overlapped by the plastic film and is thus likewise protected from the effects of moisture. However, at the first end of the valve, use is made of the fact that the paper layers of a valve provide a good sealing action under the pressure of the filling material. The paper layer preferred for the sealing is thus covered toward the outside of the bag by the film layer and thus protected from the effects of moisture. To be able to efficiently exploit the sealing action of the paper layer for the valve bag, provision is made that the film portions each extend over only part of the length of the paper layer. In this connection, it is also expedient if the film layer is wider than the paper layer, i.e. protrudes on both sides from the paper layer in the width direction, which is perpendicular to the longitudinal direction of the valve opening.

The valve design is further improved, in a manner known per se, by the fact that a reinforcement sheet made of paper, and ending at a distance from the second end of the valve, is inserted into the folding of the bottom in the area of the valve. The reinforcement sheet makes it easier to bend open the bottom opening, closed by the flat wall layers of the bag, to form a tubular valve opening.

In a preferred embodiment, the film layer has a thickness of 30 to 50 μm, preferably 40 μm. The paper layer is preferably designed with a grammage of between 50 and 100 g/m$^2$, preferably 80 g/m$^2$. However, in individual cases, it is also conceivable for the film layer in the stated thickness to be combined with a paper layer with another grammage or for a paper layer with the stated grammage to be combined with a film layer of another thickness.

BRIEF DESCRIPTION OF THE DRAWINGS

The invention is explained in more detail below on the basis of illustrative embodiments shown in the drawing, in which.

DETAILED DESCRIPTION THE INVENTION

Figure 1:
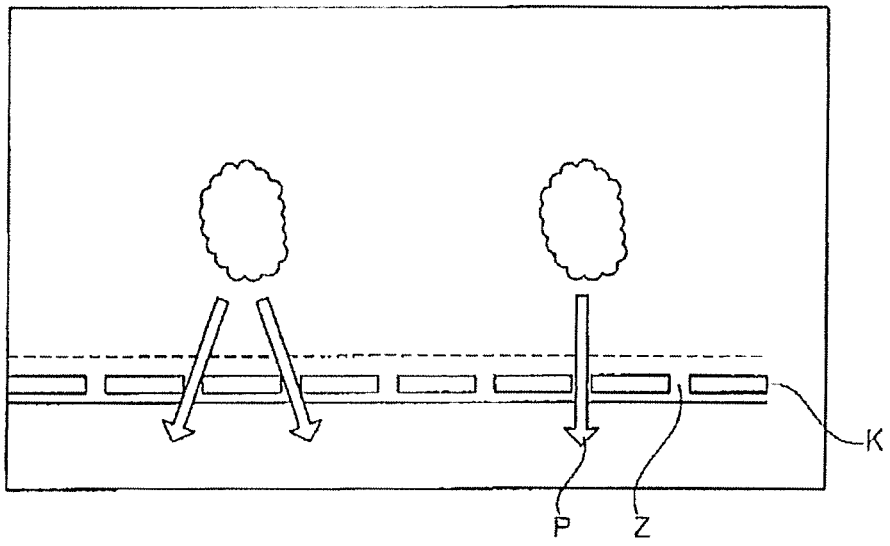
FIG. 1 shows a purely schematic view of the design of a longitudinal adhesive seam in an overlapping area of the plastic film.

FIG. 1 shows a purely schematic view of the design of the longitudinal adhesive seam in an overlapping area of the plastic film. The adhesive points K, which are here arranged in a strip shape to form a longitudinal adhesive seam, are separated from one another by small gaps Z through which air can pass from the bag interior to the outside, as is indicated by the arrows P in the drawing. The little clouds shown in the drawing represent air or gas from the bag interior before passing through the gaps Z to the outside.

Of course, other patterns of adhesion points, for example patterns which do not extend linearly but instead are planar in the overlapping strip, are also suitable for implementing the invention.

Figure 2:
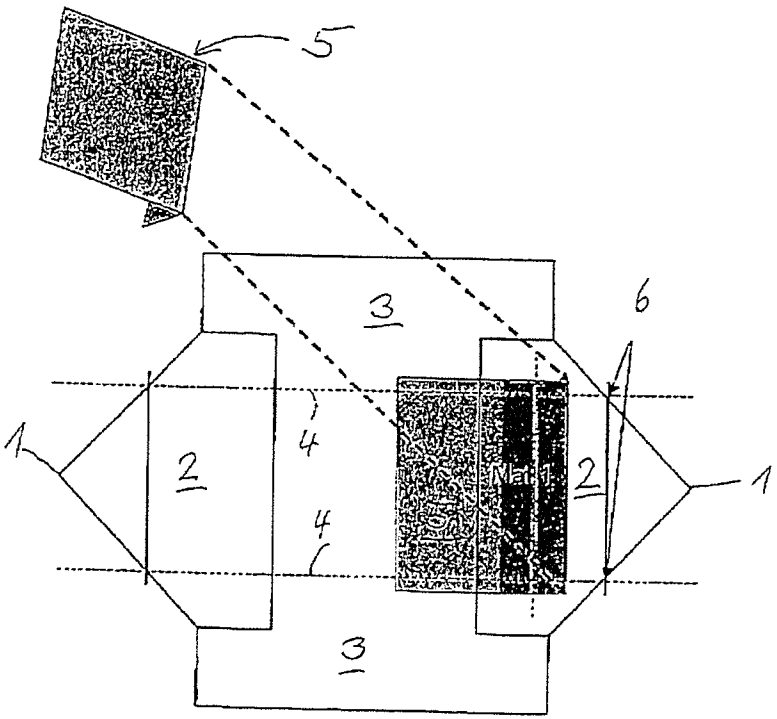
FIG. 2 shows a crossbottom partially folded by folded-in bottom corners and with open bottom flaps and the positioning of a reinforcement sheet for the valve opening.
Figure 3:
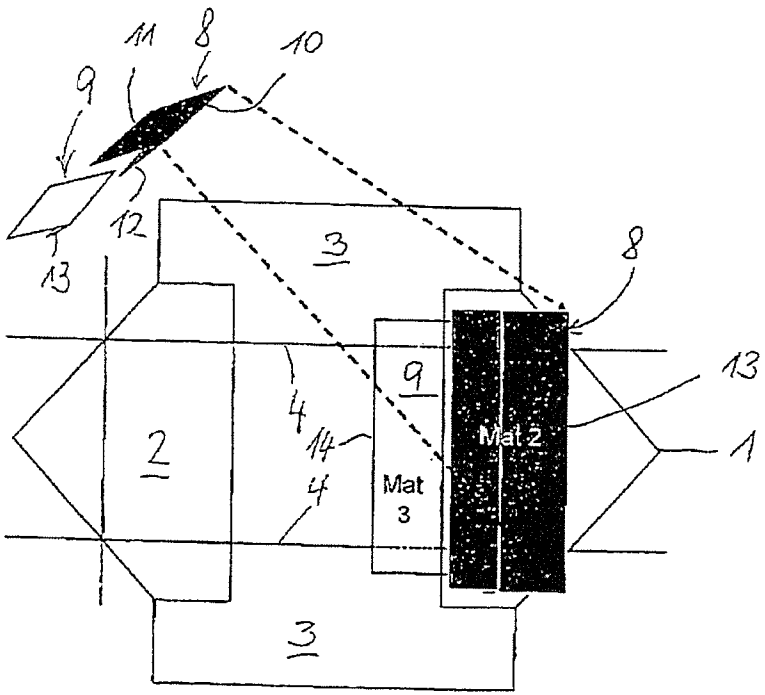
FIG. 3 shows the crossbottom in the view in FIG. 2 with the positioning of a valve of a paper layer and a film layer overlapping the paper layer at one end.
Figure 4:
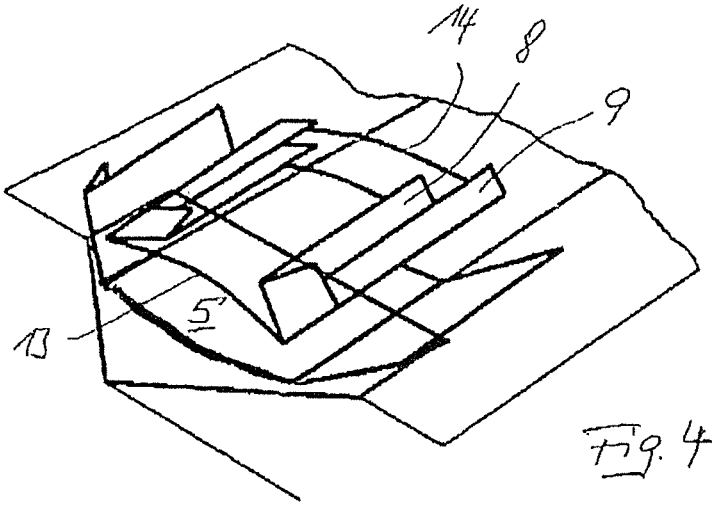
FIG. 4 shows a perspective view of the bottom according to FIGS. 2 and 3 in an exploded view with the reinforcement sheet and the valve to be fitted, formed from the paper layer and the film layer.

FIGS. 2 to 4 show the structure of a folded bottom of a bag according to the invention in a preferred embodiment. The bottom is designed as a crossbottom and arises from the fact that the bag wall has been produced as an open, flat tube with two fold lines 1. Starting from the fold lines 1, triangular pockets 2 are folded inward and cut out such that bottom flaps 3 are obtained which are connected pivotably to the large side walls of the bag via fold lines 4. The bottom flaps 3 are turned in perpendicularly with respect to the pockets 2, resulting in the design as a crossbottom.

FIGS. 2 and 3 show a folded state of the bottom in which the bottom flaps 3 have not yet been turned in. According to FIG. 2, a reinforcement sheet 5 of paper is affixed to one of the pockets that is intended to form a valve opening for an inserted valve, which reinforcement sheet 5 extends laterally over the fold lines 4 into the area of the bottom flaps 3 and is also affixed there. The reinforcement sheet 5 is preferably provided, toward the folded-in bottom corner 6, with a turned-back end, such that the corresponding end of the reinforcement sheet 5 is reinforced in a two-layer form. Upon subsequent folding back of the bottom flaps to form the crossbottom, the respective edge strip of the reinforcement sheet 5 located on the bottom flaps 3 is also turned back. The reinforcement sheet 5 is preferably made of a paper layer with a grammage of between 20 and 40 g/m$^2$, preferably 30 g/m$^2$.

According to FIG. 3, a material combination is now placed onto the arrangement according to FIG. 2 in order to form a valve.

The material combination consists of a film layer 8 and a paper layer 9. The film layer 8 is turned back about a fold line 10 and thus has an upper first film portion 11 and a lower second film portion 12. The film layer 8 configured in this way in the shape of a horizontal V receives the paper layer 9, with the first film portion 11 engaging over the upper face of the paper layer 9 and the second film portion 12 engaging over the lower face of the paper layer 9. For reinforcement reasons, the paper layer 9 also has a turned-back front end 13, which is pushed in as far as the front end of the film layer 8. The paper layer 9 is longer than the film layer 8 in the longitudinal direction of the valve, such that the paper layer 9 protrudes from the film layer 8 toward the bag interior. The film layer 8 is wider than the paper layer 9 perpendicularly with respect to the longitudinal direction of the valve. The film layer 8 and the paper layer 9 both extend laterally over the fold lines 4 of the bottom flaps 3 and are thus folded in about the fold lines 4 with the bottom flaps 3 in the formation of the folded bottom.

A valve arrangement is thus formed which, in the longitudinal direction of the valve, i.e. in the outward direction in FIG. 3, has a first end 13 and an opposite second end 14 directed toward the bag interior.

The first end 13 protrudes in this case over the front edge of the reinforcement sheet 5 and, in the unopened state of the valve opening, completely covers the reinforcement sheet 5, as a result of which the latter is protected from the effects of moisture. The second end 14 is formed by the paper layer 9 and the reinforcement sheet 5, such that a paper-on-paper seal is formed. The film layer 8 extends over only part of the paper layer 9, such that a substantial part of the length of the valve in the area of the second end 14 consists only of paper. The length of the film layer 8 is preferably between ½ and ¾ of the length of the paper layer 9.

Figure 5:
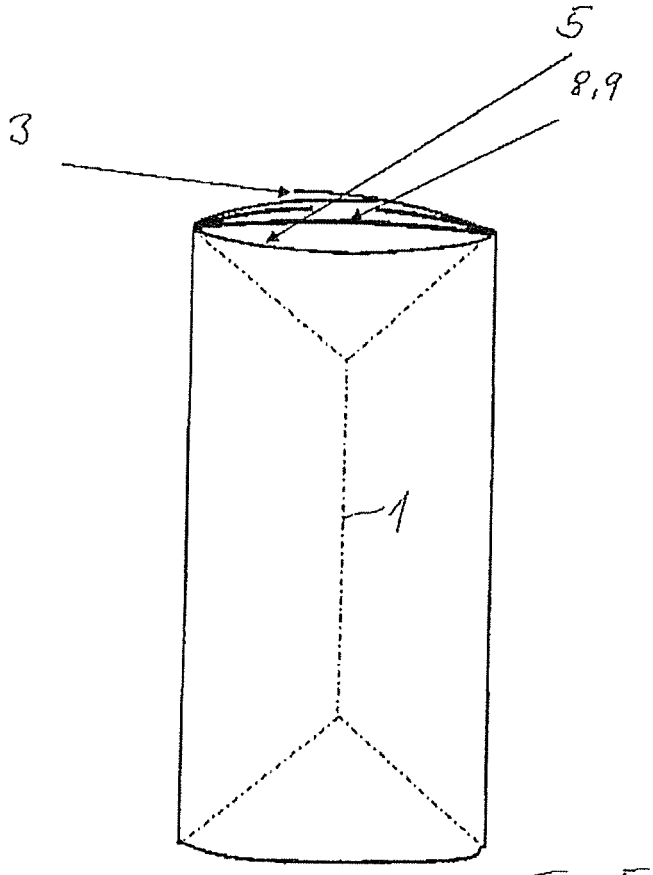
FIG. 5 shows a side view of a bag according to the invention with, for illustrative purposes, a slightly opened valve opening with the reinforcement sheet and with the fitted valve.

FIG. 5 shows a side view of a filled bag which has assumed its box shape through being filled. The typical fold lines can thus be seen which run from the middle fold line 1 to the corners of the bottom. The figure schematically illustrates the reinforcement sheet 5, the valve composed of film layer 8 and paper layer 9 and having upwardly turned edge strips, and the bottom flaps 3 located over the latter, which bottom flaps 3 form the bottom closure and are optionally covered with a bottom cover sheet (not shown). In order to distinguish the layers of the reinforcement sheet 5, of the valve 8, 9 and of the folded back edge strips, the valve opening is shown slightly opened. The closure of the valve is effected in the usual way, by means of the bag being placed standing on the bottom formed with the valve, such that the filling material introduced into the bag closes the valve, with the paper layer 9 being pressed against the reinforcement sheet 5.

The invention claimed is:

1. A bag with a jacket wall composed of at least two layers closed in each case by a longitudinal adhesive seam to form a tube and having two front ends, and with folded bottoms closing the bag at the two front ends, and with a filling opening for introducing a filling material, wherein the at least two layers of the jacket wall includes at least one paper layer which limits a load-bearing capability of the bag with a filled weight and a mechanical stability of the bag, wherein the jacket wall has one an outer surface a layer of a plastic film with a thickness of 60 μm or less, which surrounds the at least one paper layer and protects the at least one paper layer from moisture, wherein in an area of overlapping adhesion points (K) are positioned forming the longitudinal adhesive seam, wherein between which air removal paths (Z) are formed between the adhesion points (K), wherein the layer of plastic film is incorporated into the folded bottoms closing the bag at the two front ends, and wherein the layer of one plastic film is unperforated.

2. The bag as claimed in claim 1, wherein the layer of plastic film has a thickness of between 10 and 50 μm.

3. The bag as claimed in claim 1, wherein the layer of plastic film is affixed to the at least one underlying paper layer only at a plurality of points and is removable from the at least one paper layer.

4. The bag as claimed in claim 1, wherein the layer of plastic film is transparent.

5. The bag as claimed in claim 1, wherein the layer of plastic film is made of polyethylene.

6. The bag as claimed in claim 1, wherein the at least one paper layer is made of bleached paper.

7. A bag with a jacket wall composed of at least two layers closed in each case by a longitudinal adhesive seam to form a tube and having two front ends, and with folded bottoms closing the bag at the two front ends, and with a filling opening for introducing a filling material, wherein the at least two layers of the jacket wall includes at least one paper layer which limits a load-bearing capability of the bag with a filled weight and a mechanical stability of the bag, wherein the jacket wall has one an outer surface a layer of a plastic film with a thickness of 60 μm or less, which surrounds the at least one paper layer and protects the at least one paper layer from moisture, wherein in an area of overlapping adhesion points (K) are positioned forming the longitudinal adhesive seam, wherein between which air removal paths (Z) are formed between the adhesion points (K), wherein the folded bottoms include at least has two folded bottoms, a first folded bottom of the two folded bottoms includes a valve opening into which a flat valve is inserted which can be bent open in a the shape of a tube to form a filling channel filling and where the valve has a first end facing toward an interior of the bag with respect to the valve opening and a second end facing toward the jacket wall, wherein the valve has a paper layer which forms the first end of the valve and which at the second end of the valve is overlapped by a folded film layer having a first film portion and a second film portion connected to the latter via a fold line, and wherein the film layer has a thickness of 30 to 50 μm and the paper layer has a density of between 50 and 100 $g/m^2$.

8. The bag as claimed in claim 7 wherein the layer of plastic film is incorporated into the folded bottoms closing the bag at the two front ends.

9. The bag as claimed in claim 7 wherein the folded bottoms includes at least two folded bottoms, a first folded bottom of the two folded bottoms includes a valve opening into which a flat valve is inserted which can be bent open in a shape of a tube to form a filling channel for filling and where the valve has a first end facing toward an interior of the bag with respect to the valve opening and a second end facing toward the jacket wall, wherein the valve has a paper layer which forms the first end of the valve and which at the second end of the valve is overlapped by a folded film layer having a first film portion and a second film portion connected to the latter via a fold line.

10. The bag as claimed in claim 7, wherein the first and second film portions each extend over only part of a length of the paper layer.

11. The bag as claimed in claim 7, wherein the film layer is wider than the paper layer.

12. The bag as claimed in claim 7, further comprising a reinforcement sheet made of paper, and ending at a distance from the second end of the valve, wherein the reinforcement sheet is inserted into the folding of a bottom in an the area of the valve.

* * * * *